US006336735B1

(12) United States Patent
Eddins

(10) Patent No.: US 6,336,735 B1
(45) Date of Patent: Jan. 8, 2002

(54) ORNAMENTAL LIGHTING DEVICE SIMULATING A DESIRED SHAPE

(75) Inventor: Michael W. Eddins, Durham, NC (US)

(73) Assignee: MIE Enterprises, Inc., Durham, NC (US)

( * ) Notice: Subject to any disclaimer, the term of this patent is extended or adjusted under 35 U.S.C. 154(b) by 0 days.

(21) Appl. No.: 09/540,437

(22) Filed: Mar. 31, 2000

(51) Int. Cl.[7] ..... F21V 11/00

(52) U.S. Cl. ..... 362/351; 362/332; 362/353; 362/154; 362/810

(58) Field of Search ..... 362/154, 253, 362/351, 353, 360, 806, 810, 811, 332

(56) References Cited

U.S. PATENT DOCUMENTS

| | | | | |
|---|---|---|---|---|
| 273,371 A | | 3/1883 | Lindsley | |
| 365,498 A | | 6/1887 | Abbott | |
| 595,636 A | | 12/1897 | Kuhnert | |
| 1,586,114 A | | 5/1926 | Pence | |
| 2,011,252 A | | 8/1935 | Modigliani | 41/21 |
| 3,479,501 A | | 11/1969 | Pisciotta et al. | 240/108 |
| 4,072,855 A | * | 2/1978 | Marchese | 362/101 |
| 4,899,908 A | * | 2/1990 | Kardiak | 222/1 |
| 4,929,021 A | * | 5/1990 | Kaye | 297/193 |
| D329,301 S | | 9/1992 | Leonard | D26/104 |
| 5,228,771 A | | 7/1993 | Zimmerman | 362/171 |
| D400,292 S | | 10/1998 | Hoffbauer | D26/135 |
| 5,975,725 A | | 11/1999 | Ireland-Stacy | 362/357 |
| 6,050,447 A | * | 4/2000 | Kovens et al. | 221/125 |
| 6,186,637 B1 | * | 2/2001 | Marrietta | 362/101 |

* cited by examiner

*Primary Examiner*—Sandra O'Shea
*Assistant Examiner*—John Anthony Ward
(74) *Attorney, Agent, or Firm*—Olive & Olive, P.A.

(57) ABSTRACT

An ornamental lighting device in which the housing decorative design may be varied by the user. The light device has an inner housing and an outer housing with an open space between them. The inner housing surrounds the light bulb and the outer housing surrounds the inner housing. The open space is completely or partially filled with light-altering objects such as, for example, multi-colored marbles. Light from the bulb passes through the marbles so as to create a multi-colored effect.

3 Claims, 2 Drawing Sheets

ORNAMENTAL LIGHTING DEVICE SIMULATING A DESIRED SHAPE

FIELD OF THE INVENTION

The present invention relates to the field of lighting devices, and more particularly to lighting devices that provide ornamentation as well as illumination.

BACKGROUND OF THE INVENTION

Lighting devices, such as lamps, chandeliers, and the like, primarily provide illumination to an area. To enhance their commercial and decorative value, the structure of the lighting device and he shade are often made to be as attractive as possible. When the lighting device is a lamp, its base may be a sculpture, or its shade may have a graceful shape. When the lighting device is a chandelier, it may be hung by a decorative chain, and the light bulbs may be extended on radial arms.

In addition, certain lighting devices have shades that are made of colored glass in patterns, typically known "Tiffany" shades. The light emanating from a lighting device with a Tiffany shade is diffused and multi-colored, creating a warm and attractive glow.

Another type of shade for creating an interesting effect with light is that made with pierced, or cut, opaque panels. A fairly common cut pattern is that of a star. When the light from the light source, or bulb, passes through a cut star pattern in an opaque shade, the star shape is projected to a room surface to create an artistic and interesting effect. A similar effect is created by painting an opaque shape onto a shade, allowing a light outline of the shape to be projected outward from the lighting device.

The present invention recognizes that while the concepts of Tiffany style shades and pierced shades are generally considered warm and attractive in appearance, an owner of such a lighting device might, in time, desire a different appearance or lighting effect. However, there is no easy way the owner can alter the existing shade to achieve a different but warm and attractive appearance.

Therefore, it is an object of the present invention to provide a lighting device capable of assuming different configurations and creating a warm and attractive light in any of such configurations.

It is a further object of the invention to provide a lighting device in which the created effect may be easily changed by its user.

Another object is to provide a lighting device which simulates a bubble gum dispenser but gives off an easily changed warm and attractive multi-colored light.

These and other objects will be more clearly understood through the following description.

SUMMARY OF THE INVENTION

The invention provides a lighting device capable of creating a variable ornamental lighting effect. The lighting device, in the illustrated embodiment, utilizes the structure of a modified inoperative bubble gum dispenser. The device includes an inner housing surrounding a typically electrical energized light source and an outer housing surrounding and spaced outwardly from the inner housing so that a space forms between the inner and outer housings. Both inner and outer housings are able to transmit light. The space, in a first preferred embodiment, is filled with a quantity of colored and/or shaped light-altering objects, for example multi-colored glass marbles of different diameters. When the light source is illuminated, rays of light project outward through the marbles and the two housings to create a warm and artistic effect. Other items, such as shaped opaque objects, may fill the space between the housings to create different lighting effects. The device incorporates a removable cover which makes it easy to change or rearrange the marbles or other objects impinged upon by the light from the light source.

DESCRIPTION OF THE PREFERRED EMBODIMENTS

Figure 1:
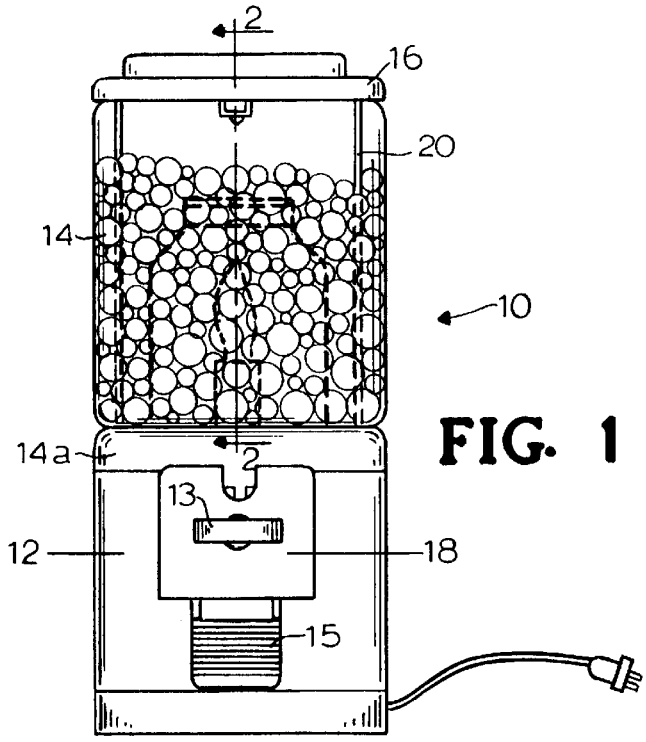
FIG. 1 is a front elevation view of the lighting device of the invention based on use of a modified, inoperative bubble gum machine.

The preferred embodiment of the invention is first described with reference to FIG. 1. Lighting device, or lamp 10 in the embodiment used for illustration is generally in the form of a simulated, inoperative candy vending machine, commonly known as a bubble gum dispensing machine. Lamp 10 comprises base 12 and an upper portion including outer housing 14. Coupling 14*a* is fixedly attached to the bottom of outer housing 14 and adapted to engage and be supported by the top edge of base 12. As is standard for bubble gum machines, outer housing 14 is transparent, or optionally translucent, and is formed of glass, plastic or the like. Base 12 includes simulated base operator 18, in this embodiment being a simulated twist knob 13 and dispenser chute 15. As the lighting device 10 is a simulated, not actual, candy vending machine, twist knob 13 and dispenser chute 15 are inoperative. Base 12 is preferably opaque. Outer housing 14 is generally a hollow cylinder, in this case being substantially square in cross section. The top of outer housing 14 has an opening at its upper end (not shown) that is closed by removable cover 16. Cover 16, in the preferred embodiment, is opaque. An optional loop 17 (shown in FIG. 2 in dashed lines) or other means of attachment may be added to cover 16 and cover 16 attached to the top of outer housing 14 by a screw, snap fit or other fitting to enable light 10 to be suspended from a ceiling or beam.

Figure 2:
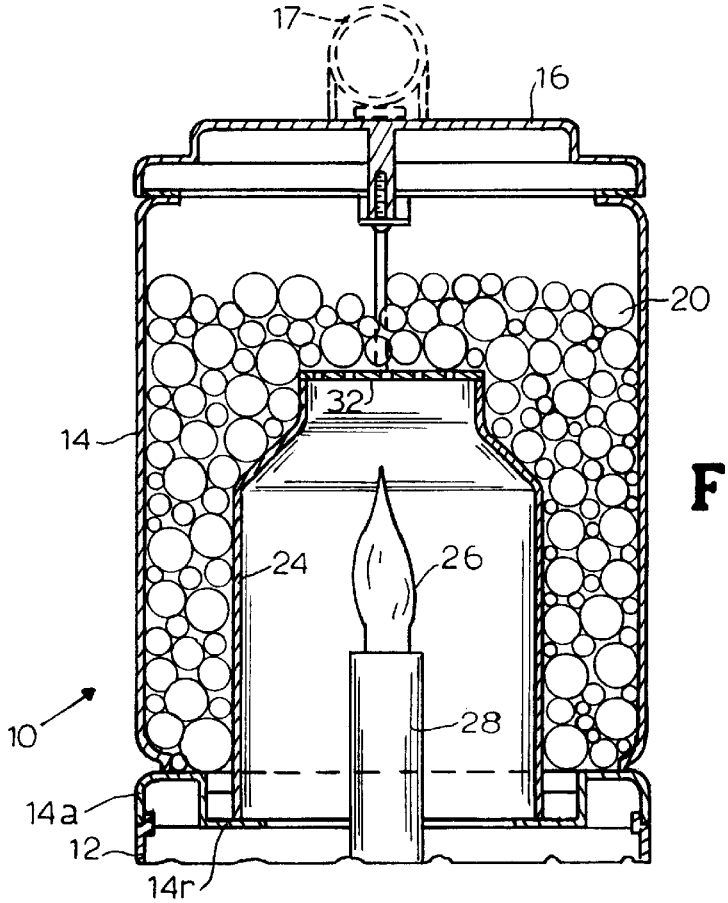
FIG. 2 is a cross sectional view of the lighting device of FIG. 1, taken in the direction of line 2—2.
Figure 3:
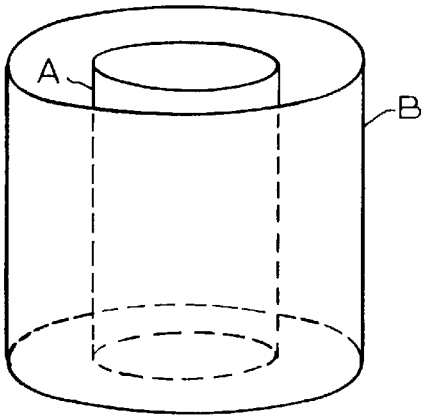
FIG. 3 is a perspective conceptual view of the housing portion of a second embodiment of the invention.
Figure 4:
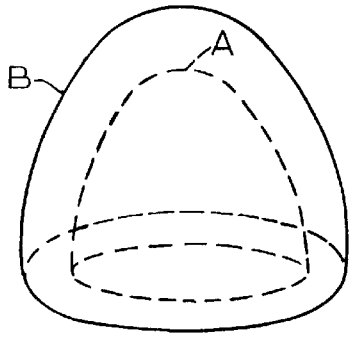
FIG. 4 is a perspective conceptual view of the housing portion of a third embodiment of the invention.
Figure 5:
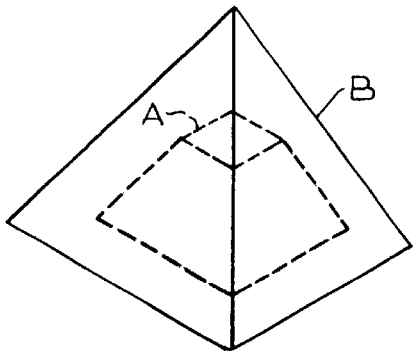
FIG. 5 is a perspective conceptual view of the housing portion of a fourth embodiment of the invention.
Figure 6:
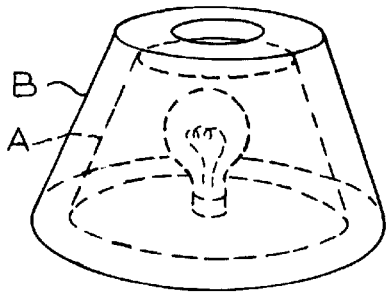
FIG. 6 is a perspective conceptual view of the housing portion of a fifth embodiment of the present invention.

Referring now to FIG. 2, lighting device 10 is shown in a cross section taken along line 2—2 of FIG. 1. Outer housing 14, coupling 14*a*, base 12, and cover 16 are situated as described with respect to FIG. 1. The outer edge of coupling 14*a* rests upon the outer top edge of base 12. A light source, for example electric light bulb 26, is mounted in a bulb holder 28 that is mounted in base 12 with bulb 26 situated thereabove. In the alternative, light source 26 may be non-electric, for example, a candle or a chemical light device. Inner housing 24 is coaxially positioned within outer housing 14 and surrounds bulb 26. It will be understood that the shape of inner housing 24 may differ from the shape of outer housing 14. The bottom edge of inner housing 24 is sized to be supported on an annular rim 14*r*. Inner housing 24 and outer housing 14 at their respective lower ends connect to and rest on coupling 14*a* and by being spaced apart provide a storage chamber for receiving and holding the marbles 20.

The upper portion of inner housing 24 is partially closed by vent 32 which is perforated with an array of openings to allow the air heated by bulb 26 to escape. A gap exists for the escape of heated air at the intersection of outer housing 14 and cover 16. The space between inner housing 24, vent 28 and outer housing 14, in the illustrated embodiment, is filled or partly filled with a plurality of glass marbles 20 of different color and diameter or other light-altering objects. Inner housing 24 and outer housing 14 are preferably made of substantially rigid, light-transmitting material. When bulb 26 is lit, its illumination travels outward through inner housing 24 and vent 32, through the marbles 20 or other light-altering objects, through outer housing 14, and into the surrounding room, causing a unique and artistic effect. Perforated vent 32 may be formed of an opaque material which, in an alternate embodiment that has a light-transmitting cover, will add a silhouette dimension to the light-altered effect of the invention.

The light-altering objects 20, in the illustrated embodiment being colored marbles, are visible through outer housing 14. When the light source, being a bulb (shown in dashed lines) that is obscured from direct view by the light-altering objects 20, is illuminated, light will radiate outward through the marbles and cause colored lighting to be transmitted into the room in which situated. When the light source is not illuminated, the apparatus appears like a bubble gum vending machine filled with marbles. In either case, the invention provides substantial decorative effect to a room. The preferred embodiment light-altering objects, marbles, are considered to be interesting and attractive by virtue of having differing diameters and differing colors. In order to achieve a different effect, the user may remove the cover 16 and change the marbles being used for other marbles or for other objects, or change the light source, at will.

As will be understood, the lighting device of the invention may, in other embodiments be in the form of a simulated fish bowl, diver's helmet, computer, or the like, rather than a bubble gum vending machine. Variant conceptual geometric shapes of the housings are illustrated in FIGS. 3–7 and are contemplated as being within the scope of the invention.

While FIGS. 1 and 2 show the preferred embodiment of the present invention having a plurality of marbles occupying the space between outer housing 14 and inner housing 24, other light-altering objects may be used as previously maintained. Some examples of other type of light-altering objects are opaque or translucent stars, triangles, etc., hollow rings and translucent sea shells.

As will be apparent to those skilled in the art, the invention described above in terms of a preferred embodiment is susceptible to numerous variations of shape and size. Referring now to FIGS. 3–7, a number of alternate embodiments of the housing portion of the present invention are conceptually illustrated. In each such alternate embodiment, an inner housing A and an outer housing B are assembled to provide a space therebetween. The space is adapted to be filled by the user with one or more light-altering objects, such as marbles or the like. In FIGS. 3–6, the inner housing A and outer housing B are suitably connected at their lower ends to form a storage space in which to retain the marbles or other light-altering objects.

Figure 7:
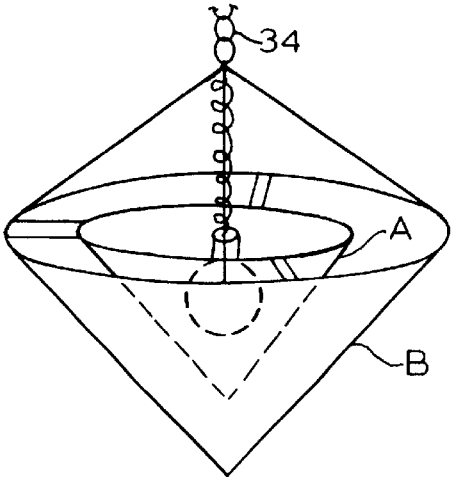
FIG. 7 is a perspective conceptual view of the housing portion of a sixth embodiment of the invention.

Referring now to FIG. 7, the depicted embodiment of the invention is adapted for hanging from a ceiling supporting surface by a suspension member, or chain 34. In FIG. 7, the inner housing is shown supported on and within outer housing B. In this example, the marbles 20 or other light-altering objects are stored in the space surrounding and below inner housing A. Those skilled in the art will also understand that others of the illustrated alternate embodiments are also capable, with the addition of a suspension member, of being suspended.

The description above of specific embodiments of the invention is considered to be an example thereof and not a limitation of the scope of the invention as set forth in the following claims.

What is claimed is:

1. An ornamental lighting device that simulates the appearance of a candy vending machine, comprising:

(a) a base that simulates the appearance of a base of a candy vending machine by having an inoperative twist knob and dispenser chute, being adapted for being supported on a horizontal surface;

(b) a light source removeably mounted in said base;

(c) a first transparent housing removeably mounted on said base and enclosing said light source;

(d) a second transparent housing that simulates the appearance of a candy vending machine upper portion and is removably mounted on said base to enclose said light source and said first housing so as to form a space between said first and second housing; and (e) a plurality of light-altering objects residing in said space such that light emitted by said light source is able to pass through said space and be seen according to the character of said objects.

2. The ornamental lighting device of claim 1, wherein said light-altering objects comprise substantially transparent colored marbles.

3. The ornamental lighting device of claim 1, wherein said light source comprises an electric light bulb.

* * * * *